US008142208B2

(12) United States Patent
Ruffner

(10) Patent No.: US 8,142,208 B2
(45) Date of Patent: Mar. 27, 2012

(54) ADAPTER PLUG

(76) Inventor: Walter Ruffner, Jolly Harbour (AG)

( * ) Notice: Subject to any disclaimer, the term of this patent is extended or adjusted under 35 U.S.C. 154(b) by 0 days.

(21) Appl. No.: 12/999,960

(22) PCT Filed: Jun. 16, 2009

(86) PCT No.: PCT/CH2009/000206

§ 371 (c)(1),
(2), (4) Date: Dec. 21, 2010

(87) PCT Pub. No.: WO2009/152631

PCT Pub. Date: Dec. 23, 2009

(65) Prior Publication Data

US 2011/0111634 A1 May 12, 2011

(30) Foreign Application Priority Data

Jun. 17, 2008 (CH) ..... 0924/08

(51) Int. Cl.
*H01R 4/66* (2006.01)

(52) U.S. Cl. ..... 439/105

(58) Field of Classification Search ..... 439/172, 439/105–107, 957, 101
See application file for complete search history.

(56) References Cited

U.S. PATENT DOCUMENTS

| | | | | |
|---|---|---|---|---|
| 4,626,052 | A * | 12/1986 | Rumble | 439/173 |
| 6,227,883 | B1 * | 5/2001 | Lee et al. | 439/106 |
| 6,328,581 | B1 * | 12/2001 | Lee et al. | 439/106 |
| 6,999,052 | B2 * | 2/2006 | Pfeiffer et al. | 345/89 |
| 7,381,067 | B2 * | 6/2008 | Sze | 439/131 |
| 7,445,513 | B1 * | 11/2008 | Lee | 439/652 |
| 2006/0148291 | A1 * | 7/2006 | Bona et al. | 439/172 |

FOREIGN PATENT DOCUMENTS

| | | |
|---|---|---|
| DE | 88 06 144 U1 | 7/1988 |
| DE | 198 45 962 C1 | 10/1999 |
| DE | 200 14 987 | 10/2000 |
| EP | 0 156 076 A | 10/1985 |
| EP | 0 616 389 | 9/1994 |
| EP | 1 257 018 | 5/2002 |
| GB | 2 366 087 | 2/2002 |
| WO | WO 02/063722 | 8/2002 |
| WO | WO 02/063723 | 8/2002 |
| WO | WO 2007-015156 | 2/2007 |

* cited by examiner

*Primary Examiner* — Neil Abrams
*Assistant Examiner* — Harshad Patel
(74) *Attorney, Agent, or Firm* — Morriss O'Bryant Compagni, P.C.

(57) ABSTRACT

The invention relates to a three-pole adapter plug (11), comprising, on a first side, a safety plug (13) with two pins (31, 33) and two earth conductors (23,24), in particular a hybrid plug according to the standard CEE 7/7 with an additional contact sleeve (49.5) for a FR earth pin. On the second side, opposite to the first side the adapter has a socket (15) for at least one plug of British standard. A housing (41,43) for the adapter plug (11) forms a safety plug body (21). Contact sleeves (45.3, 47.3, 49.3) for such plugs to British Standards are arranged within the safety plug body (21). According to the invention, one of said earth conductors (23) of the safety plug (13) forms a contact sleeve (49.3) for the UK earth pin on the inner side thereof.

15 Claims, 8 Drawing Sheets

ADAPTER PLUG

CROSS-REFERENCE TO RELATED APPLICATIONS

This application claims priority to PCT Patent Application No. PCT/CH2009/000206 filed on Jun. 16, 2009 and Swiss Patent Application No. 924/08 filed on Jun. 17, 2008, the entirety of each of which is incorporated by this reference.

FIELD OF THE INVENTION

The invention relates to a three-pole adapter plug between a socket of the German and/or French standard(s) and a plug of the British standard.

STATE OF THE ART

It is well known that hybrid earthed plugs may be inserted in sockets of the German and French standards. An adapter plug comprising such a hybrid earthed plug and insertion sleeves for a plug of the British standard is known from GB-A 2 366 087. At one end face this is constructed in such a way that a large number of different end plates with plug-in contacts of different standards may be arranged at that location. The back of the adapter plug is designed for a large number of sockets to be arranged thereon. Therefore various standards of plug-in contacts may be combined with various standards of socket. As a result, the adapter plug desired for the specific situation may be assembled from a set of parts. An exemplary embodiment shows an adapter plug of this kind having a grounded plug and a multiple socket for the standards of the UK, US, AU, IT and other territories.

In order to be able to insert the UK plug into the insertion body of the grounded plug, the planes of symmetry of the grounded plug and the UK socket have to be tilted toward each other for reasons of space. The wall of the grounded insertion body has grooves on the inside which appear on the outside of the grounded insertion body as guide ridges. The grooves or guide ridges are provided in the two mutually opposing, flattened regions of the grounded insertion body according to standards. Two such inner grooves for the ground pin and for the phase pin are formed between opposing earth contacts of the grounded plug and one of the two flattened regions respectively. A third groove engages with a corner in one of the two guide ridges. As a result not only is the plane of symmetry of the UK socket tilted with respect to the plane of symmetry of the grounded plug but the intersection is not exactly located on the cylinder axis of the grounded insertion body either.

Not only does the tilting of the two planes of symmetry have an aesthetically adverse effect such that a UK plug cannot be inserted in the wall in the orientation of the earthed socket, it also demands that the inner electrical connections between the pins of the grounded plug and the insertion sleeves for the plugs of different standards have to be relatively complicated and, above all, asymmetric.

It is therefore an advantage of the invention to create a three-pole adapter plug with a hybrid earthed plug and at least one socket for insertion of plugs of a different, in particular British, standard in which a simple internal structure is achieved. A further aim is to provide an adapter plug in which plugs of other country standards may be inserted. A further aim is to propose an optimally compact adapter plug.

SUMMARY OF THE INVENTION

According to a first aspect of the invention the three-pole adapter plug has on a first side a grounded plug with two pins and in the region of the insertion body two earth conductors, and on a side, opposite the first side, a socket for at least one plug of the British standard. The socket for plugs of the British (UK) standard is combined with additional sockets of other countries, such as the US, AU, IT, etc., so a multiple socket is achieved. The housing of the adapter plug forms a grounded insertion body. Contact sleeves for plugs of the British standard are compactly arranged within the grounded insertion body. As a result of the fact that the contact sleeve for the ground pin of the British standard is arranged in the same plane of symmetry as said ground conductors of the grounded plug one of said earth conductors of the grounded plug can be used on its inner side as a contact for the UK earth pin. The contact sleeves for the UK pins may therefore be arranged symmetrical to a plane of symmetry that is predefined by the symmetry of the grounded plug. This plane passes through the ground conductors of the grounded plug. Both the pins of the grounded plug and the contact sleeves of the socket are therefore symmetrically constructed with respect to a common plane of symmetry through the ground conductors of the grounded plug. This arrangement has the advantage that the contact strips with the contact sleeves may be very simply configured. In the case of a UK plug inserted in the UK socket a narrow side of the UK ground pin is in direct contact with the ground contact arranged in a recess of the plug housing. Furthermore, the mutually opposing flat sides of the UK ground pin may be in contact with a clamping sleeve of the ground clamping element.

A hybrid plug according to the CEE 7/7 standard with an additional contact sleeve for a FR earth pin is formed on the plug housing. A plug of this kind has the advantage that it may be inserted in grounded sockets and FR sockets that are not compliant with standards.

According to one embodiment the grounded insertion body, at least in the region of the UK neutral conductor and UK phase contact sleeves, has a shape that differs from a hypothetical cylinder, whose central point is located in the center of the intersection of the plane of symmetry and a plane passing through the grounded pins. In a second region, which diametrically opposes the UK neutral conductor and UK phase contact sleeves, the grounded insertion body may advantageously have a shape that also differs from a hypothetical cylinder. In said regions the radius may be smaller by an appropriate amount, so the required standard diameter of 37 mm is retained.

So the UK pins for the neutral conductor and phase have space within the insertion body the spacing of the ground conductor that forms the contact sleeve for the UK earth pin from a cylinder encompassing the insertion body is advantageously selected so as to be less than usual. This may be achieved by the mutually opposing earth conductors being eccentrically arranged, by <1 mm, or even <0.5 mm, with respect to the central point and being displaced in the direction of the UK earth pin. Additional space may consequently be obtained for the positioning of the UK plug. However, the displacement is so slight that it is still within a margin which is compatible with grounded sockets compliant with standards.

So there is sufficient space available for the UK plug pins, the outer shape of the insertion body is advantageously widened at two of the locations opposing the ground conductor that forms the contact sleeve. This widening can be limited to the part of the outer wall of the insertion body which is directly adjacent to the clamping sleeve for the UK neutral conductor and phase pins. However, the protrusion in the plug housing is expediently kept so small that it lies within the minimally specified cylindrical space of the grounded socket.

The grounded insertion body according to the invention does not have a rotationally symmetrical design in the rounded sections therefore, so it provides sufficient space for the symmetrical arrangement of the UK pin within the insertion body and also still fits into a grounded socket even if this only has the minimal required internal dimensions. The margin between the maximal external dimensions of a grounded plug and the minimal internal dimensions of an earthed socket is sufficient to provide the UK plug-in contact with sufficient space within the grounded insertion body such that it may be arranged symmetrically with respect to the grounded plug.

The ground conductor which is adjacent to the contact sleeve of the UK ground pin advantageously has a smaller spacing than usual from a cylinder encompassing the insertion body. However, this is within a margin which is compatible with grounded sockets compliant with standards. Additional space may therefore be created for the arrangement of the UK plug pins. The mutually opposing ground conductors may therefore have an unequal spacing from the edge of the recess in which they are arranged.

Alternatively, it may also be provided in the case of the ground conductor and/or the shape of the insertion body that at two of the locations opposing the ground conductor that forms the contact sleeve the insertion body has two slots in the housing which are occupied by the neutral conductor and phase pins of a UK plug inserted in the socket. If the grounded insertion body is inserted in a grounded socket the slots are located in the depression in the socket and are therefore covered so there is no danger to the user of coming into contact with the live pin, and this is also the case because the UK phase pin is insulated up to its tip. Therefore conductive metal only becomes accessible again when the grounded pins are not in contact with the plug sleeves of the socket in which the plug was inserted.

Clear relationships result inside the adapter plug with a symmetrical arrangement of the contact sleeves. A ground contact element is advantageously present which forms all ground contact sleeves for the socket, for the ground conductors or the earthed plug and optionally the contact sleeve for the FR ground pin. The ground contact element can have a one-piece construction. It is formed symmetrically with respect to said plane of symmetry.

A phase contact element and a neutral conductor contact element are also expediently naturally present and form the corresponding contact sleeves for the socket. These contact elements are connected to the pins of the grounded plug and are constructed and arranged symmetrically with respect to each other.

A simple construction for these contact elements results if the phase contact element and the neutral conductor contact element consist of two conductive parts respectively. These conductive parts are connected to each other by the pin of the grounded plug. The pin extends through the two parts and is connected to the two parts of a contact element by spot welding or riveting.

A hold-down device is advantageously present so the contact sleeves are not displaced from the intended location by the insertion and removal of pins. This hold-down device supports the contact sleeves within the insertion body with respect to the housing. In particular it supports the ground contact element, the phase contact element and the neutral conductor contact element. This results in a very simple construction and simple assembly of the parts of the adapter plug.

The hold-down device expediently separates the contact sleeves for phase and the contact sleeves for earth and the contact sleeves for the neutral conductor from each other. It therefore creates at least three spaces within the insertion body which are separated from each other to the extent that the required air and creepage distances between the phase, neutral conductor and ground contacts are retained.

To guide and hold the hold-down device grooves and/or ridges are advantageously formed in the insertion body on the inside of the housing, in and/or between which the hold-down device reaches. These may also be used to extend air and creepage distances.

Even if a hold-down device is present a displaceably mounted make contact may exist. A make contact of this kind can be displaced, counter to a spring force by the UK earth pin that is to be inserted into the socket, from a position that closes the insertion openings for the UK pin into a position that frees these insertion openings. If a hold-down device is present it can form a guide for the make contact. The hold-down device is then supported on the housing, in particular on the cover, through openings in the make contact.

A simple construction is achieved with a three-pole adapter plug which has on a first side a grounded plug with two pins and two earth conductors, and on a side, opposite to the first side, has a socket for at least one plug of a different standard, if a housing of the adapter plug forms an a grounded insertion body with a first housing part and a cover with a socket-side, second housing part, and contact sleeves for such plugs of a different standard are arranged within the grounded insertion body, and if the contact sleeves are held by a hold-down part independent of the cover against the inside of the first housing part and are supported against the cover. A displaceably mounted make contact, which is guided on the holding hold-down part and/or the cover, may, moreover, be arranged between the hold-down part and the cover.

This construction allows the following assembly: the conductive contact elements are produced by punching and bending and, if a contact element has a multipart construction, the parts of the contact element are joined together. At the same time the two parts of the housing, the hold-down part and optionally the make contact, are produced from plastics material in an injection moulding process. The contact elements with the contact sleeves for the ground pins, the phase pins and the neutral conductor pins are placed in the housing part, which forms the insertion body, symmetrically to the plane of symmetry of the insertion body, with the grounded pins connected to these contact elements being pushed through the openings, provided for the pins, in the base of the insertion body. Alternatively these contact elements may be placed in an injection mold and the housing part, which forms the insertion body, is then injected around these parts. The hold-down part is then inserted. A make contact is optionally placed on the hold-down part. Finally the cover is laid over and cover and insertion body are screwed together.

The contact elements are advantageously constructed in one piece. This greatly simplifies assembly of the adapter plug. The multiple socket expediently comprises a UK socket and at least two sockets of the following country standards: USA, Switzerland, Italy (IT), Australia (AU), Denmark (DK), India (IN) or Israel (IL) but no grounded socket.

BRIEF DESCRIPTION OF THE DRAWINGS

The invention will be described in more detail below with reference to the figures, in which.

DETAILED DESCRIPTION OF THE ILLUSTRATED EMBODIMENTS

Figure 1:
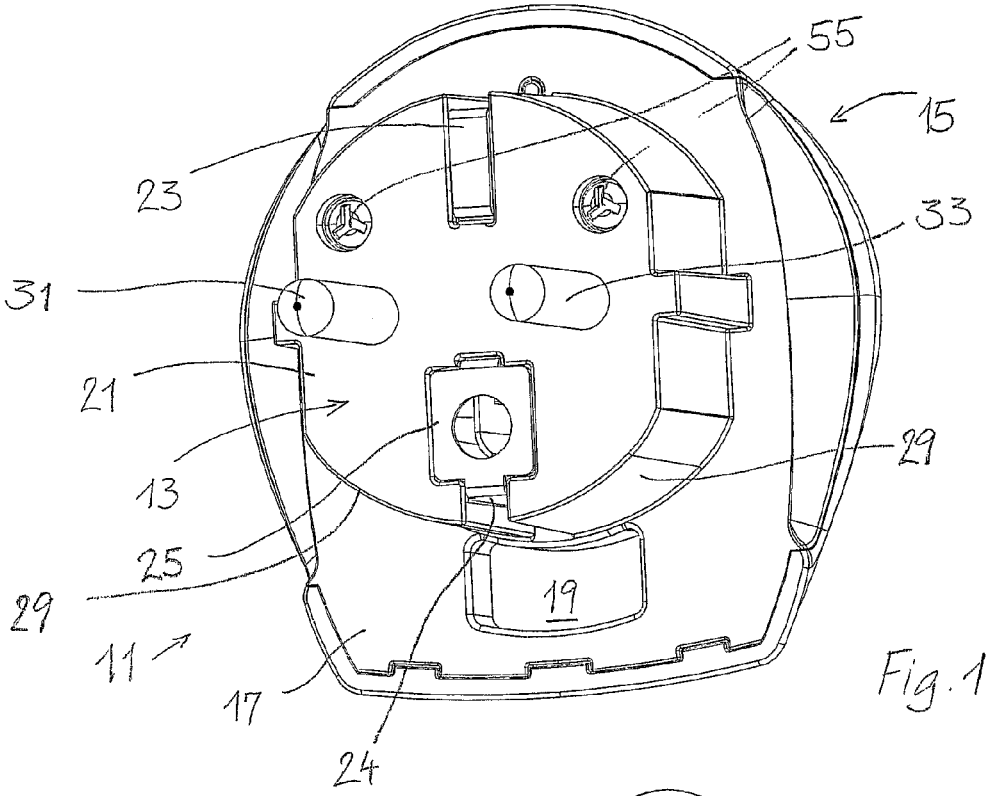
FIG. 1 shows the adapter plug in a perspective from the plug side.
Figure 2:
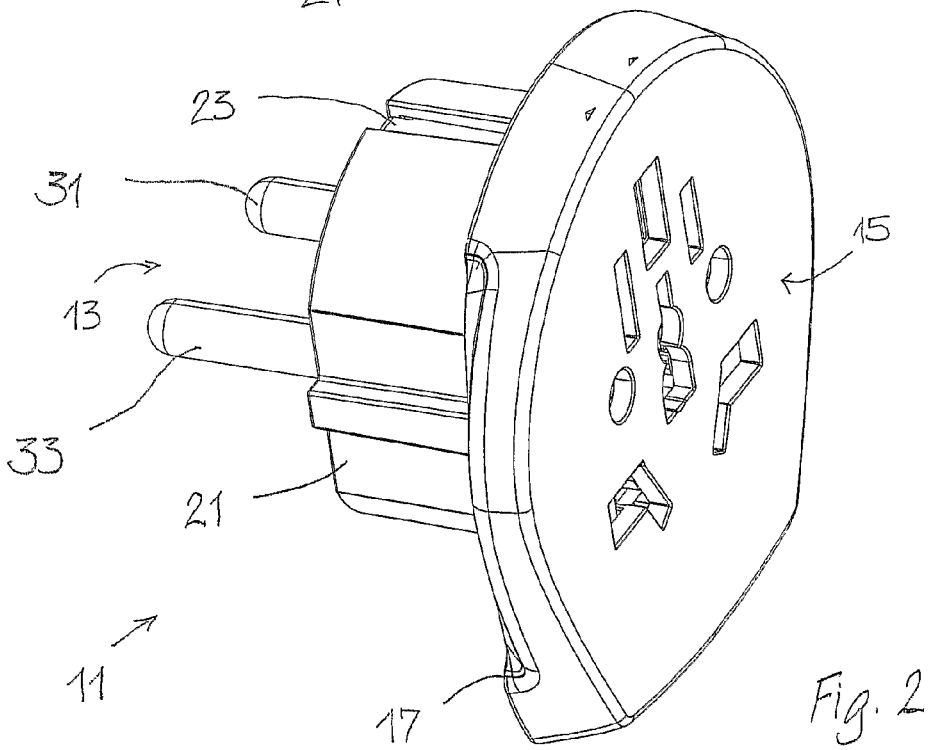
FIG. 2 shows the adapter plug in a perspective from the socket side.

FIGS. 1 and 2 show an adapter plug 11 which has an plug complaint with standards on one side and a multiple socket 15 on the side opposite to the grounded plug 15.

To ensure the correct polarity of the grounded plug that is not intrinsically polar the adapter plug 11 has a collar 17 in which a recess 19 is provided. This recess 19 can cooperate with a corresponding projection at the edge of a grounded socket, so incorrectly polarised insertion of the adapter plug into the grounded socket is not possible. However, the collar is at least in part also necessary to be able to maintain the specified spacings of the socket edge from the holes for inserting the pins.

The grounded plug has a grounded insertion body 21 whose form is specified for example by standard DIN 49441. The form of the grounded socket is also specified by a standard, namely by standard DIN 49440-1. According to these standardized specifications tolerances exist for the individual dimensions within which the specific dimensions may vary. These specifications ensure that each grounded plug in each assembled grounded socket and each plug of standard CEE 7/7 can be inserted in each grounded socket and each FR socket. The specified dimensions, including tolerances, ensure that there is always still a clearance between the minimal dimensions of the grounded socket and the maximal dimensions of the insertion body 21.

If for the production of an adapter plug the pins of a UK plug are to be inserted in a grounded insertion body the contact sleeves for the UK pins have to be arranged within the insertion body 21. Owing to the specified dimensions for the UK plug and grounded socket only one possible arrangement was previously known, namely, if the planes of symmetry of UK plugs and grounded insertion body 21 are tilted toward each other in the manner that has become known through GB-A 2 366 087. If the UK pins are to be arranged symmetrically to the plane of symmetry of the insertion body 21 the UK pins and the contact sleeves would generally be arranged behind the insertion body for this. However, the adapter plug according to the invention has the contact sleeves for the UK pins symmetrically arranged in this insertion body with respect to the plane of symmetry of the grounded insertion body 21. This has been achieved by deviating slightly from the conventional shape of the grounded plug housing but only to the extent that still ensures the compatibility of the modified insertion body 21 with sockets compliant with standards.

A first modification may be provided on the grounded plug 13 in the region of the ground conductor 23. The ground conductors 23 are arranged in recesses 22 in the plug housing, it being possible for the outer spacing of the ground conductors to be 32 mm+0.5 mm according to DIN 49 441 32. It is not possible to insert the UK ground pin in the case of ground conductor 24, which adjoins the insertion sleeve 25 for the FR ground pin. FR ground pin and UK ground pin would occupy the same space inside the insertion body 21. Therefore, if the grounded plug has the advantageous hybrid form, the ground conductor 23 arranged adjacent to the insertion sleeve 25 for the FR ground pin forms a contact surface for the ground pin of the UK plug. This contact point will be described in more detail below in connection with FIG. 7. In order to create more space for the UK plug the ground conductors 23, 24 arranged on a common contact element may be displaced by a small distance of <1 mm, or even about 0.5 mm, in the direction of ground conductor 23, i.e. the ground conductors can have an unequal spacing from the spacing to the outer edge of the recess.

In the illustrated embodiment the grounded plug is a hybrid and therefore has an insertion sleeve 25 for the FR ground pin. This insertion sleeve 25 and the associated contact sleeve 49.5 arranged inside are integrally formed with the ground conductors 23 and 24 of the plug. The ground conductor 23, which forms the contact sleeve 49.3 for the UK pin (FIG. 7) is guided on the end face of the grounded insertion body 21, so the depth of the adapter plug 11 is minimal and exceeds the length of the UK ground pin only by the thickness of the material of the ground conductor 23 and the length of the grounded pin.

Figure 8:
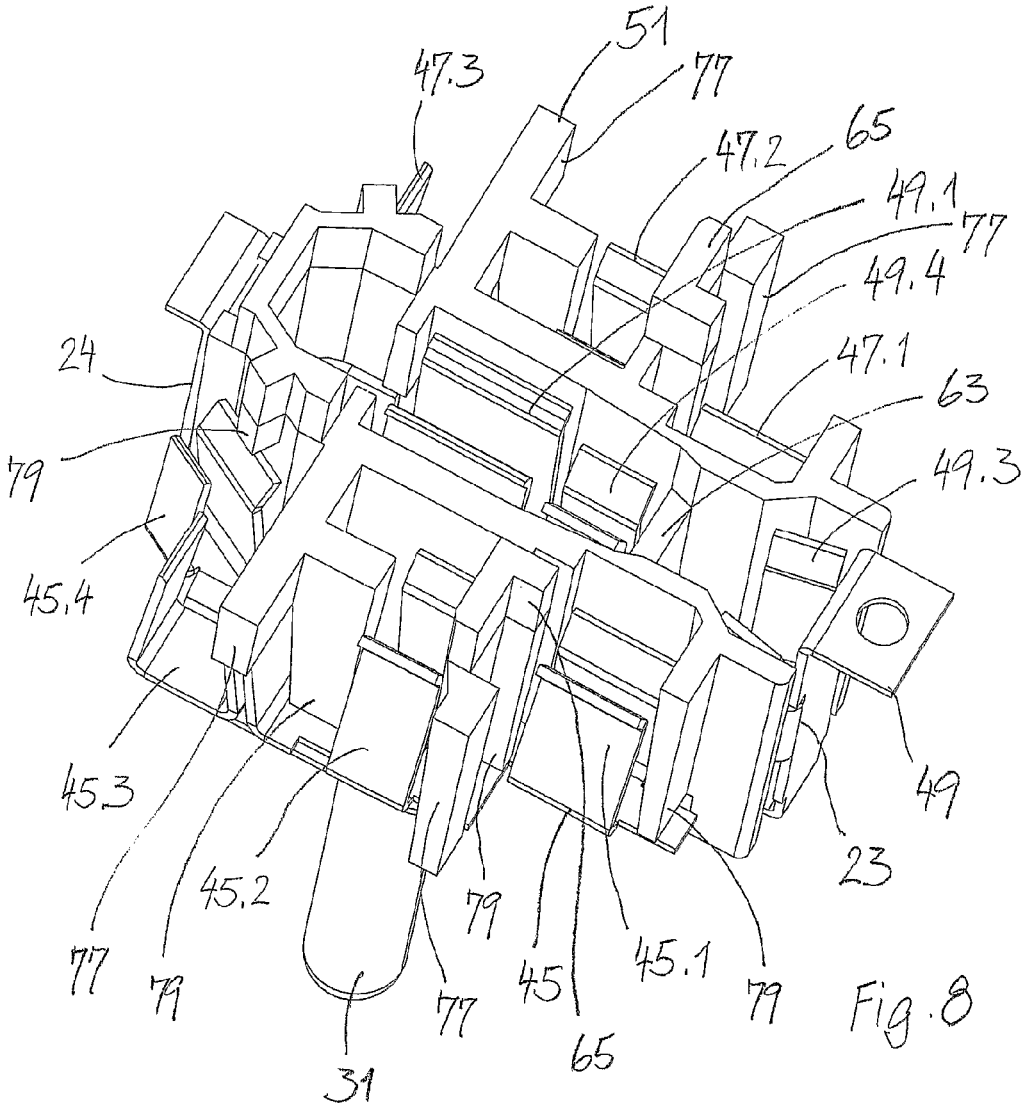
FIG. 8 shows in a perspective view the three live contact elements together with the hold-down device.

A deviation from the conventional form of the plug housing is provided in the depicted exemplary embodiment in the region of the housing wall section 29 of the insertion body 21 that is circular in cross-section. At the locations denoted by 29 this housing wall section 29 does not follow a circular path with centre 80 but in certain locations, in particular at the edge which is adjacent to the contact sleeves 45.3, 47.3 of the UK neutral conductor and UK phase pins, has a larger radius or a protrusion 82 (FIG. 8). However, this deviation lies within the minimal diameter of the insertion opening of the grounded socket. Compatibility is therefore not called into question by the minimal deviation from a cylinder. As a result of this deviation it is, however, possible to completely accommodate the contact sleeves 45.3, 47.3, 49.3 for a three-pole UK plug within a closed grounded plug housing without one of the UK pins poking laterally out of the plug housing. As may be seen in particular from FIG. 10, the housing wall of the plug housing 21 can still have a thickness of 0.3 to 0.7, optimally about 0.5 mm, in the region 29 of the contact sleeves for the UK neutral conductor and phase pins.

According to a further embodiment the outer form of the insertion body 21 may be configured as a cylinder with standard dimensions. In this case a respective slot is provided in the wall of the plug housing (not shown in the figures) in the respective regions 29 directly adjacent to the UK contact sleeves 45.3, 47.3 If a UK plug is inserted in the adapter plug 11 the outermost edge of the neutral conductor and phase pins comes to rest in said slots with the edges aligning approximately with the outer wall. If the grounded plug is inserted in a grounded socket the UK neutral conductor and phase pins then lie within the grounded socket, however, and are covered by it. Security against electric shocks is therefore also provided in this embodiment by lateral slots in the insertion body 21.

According to one embodiment the socket side of the adapter plug is a multiple socket 15. The hole pattern for plugs of different standards are all identically polarised. A multiple socket 15 for plugs of the following standards: UK (designated by 35 (phase), 36 (neutral conductor) and 37 (earth)), US, AU, IT and CH is shown by way of example in the figures.

Figure 3:
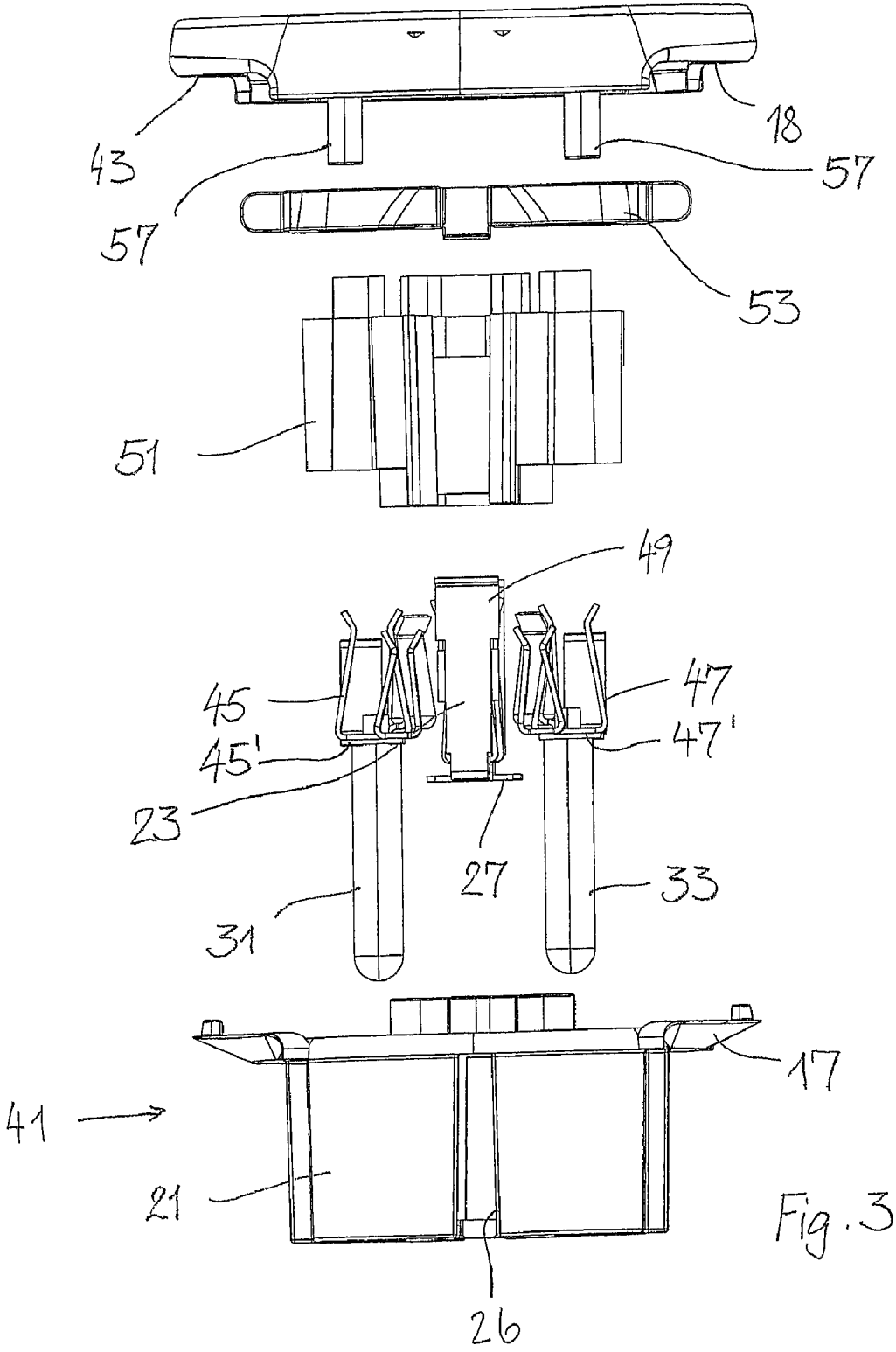
FIG. 3 shows the parts of the adapter plug ordered in the sequence of assembly.

The exploded view shown in FIG. 3 illustrates the essential components of the adapter plug 11. The adapter plug has a housing with a first housing part 41 which includes the insertion body 21 and a flange 17 formed on the insertion body. A second housing part in the form of a cover 43 may be placed on the flange 17 with its edge 18.

The electrically conductive contact elements 45 (phase), 47 (neutral conductor), 49 (earth) are arranged within this housing 41, 43. The contact elements for the phase and the neutral conductor consist of a flat contact strip 45' and 47' and contact terminals 45 and 47 which rise roughly perpendicularly from the contact strips 45' 47'. The ground contact conductor 23 and the FR ground insertion sleeve 25 can be seen on the ground contact element 49 (FIG. 1).

Figure 4:
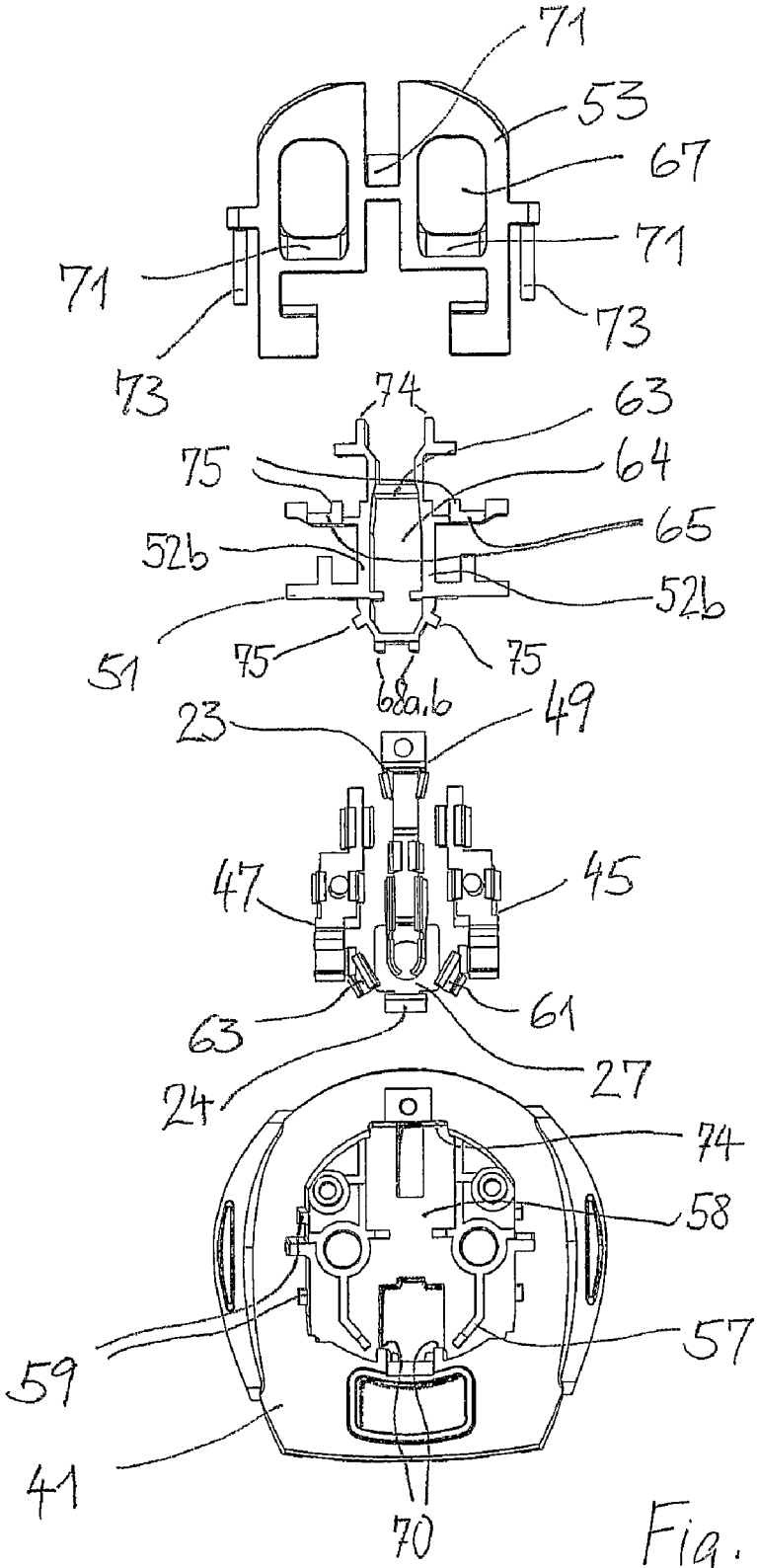
FIG. 4 shows the same parts (without cover) as in FIG. 3 side by side.

A hold-down device 51, which can be inserted in the insertion housing 21, is supported on the cover 43 and fixes the contact elements 45, 47, 49 in their position. The hold-down device 51 has walls 52*a*, 52*b* which separate the contact elements 45, 47, 49 from each other (FIG. 4).

A make contact 53 is displaceably arranged on the hold-down device 51. The make contact 53 is pre-tensioned by means of spring elements (not shown in the figures) in an end position in which the make contact 53 partially closes the insertion openings in the various sockets that are present in the cover 43. This prevents children from being able to come into contact with live parts of the adapter plug 11 when playing.

The plug housing 21 can be closed by the cover 43. Hollow pins 57 are provided on the bottom of the cover into which screws 55 may be screwed (FIG. 1).

The adapter plug 11 should be assembled as shown in FIG. 3: firstly the contact elements 45, 47, 49 should be inserted in the first housing part 41. The hold-down device 51 is then introduced into the plug housing. The make contact 53 should be inserted in the cover 43 and the cover 43 can then be placed on the hold-down device 51 and the first housing part 41. The adapter plug 11 can now already be screwed together using the screws 55.

In addition to screws and spring means, the exploded view of FIG. 4 is missing the cover 43. Webs 57 are formed on the side 58 remote from the end face 56 of the first housing part 41 and grooves 59 are formed on the inside of the housing. The phase contact element 45 and the neutral conductor contact element 47 rest on the webs 57. As may be seen from FIG. 3, these are raised from the end wall 56 of the insertion body 21 by the height of the web 57. A first recess 60 for the ground contact conductor 49 and a second recess 62 for the insertion sleeve 27 of the FR ground pin are provided in the end wall 56. The one-piece ground contact element 49 extends from the ground conductor 23 to the opposing ground conductor 24 with the contact element 49 in the region of the first and second recesses 60, 62 extending so as to be approximately aligned with the outside of the end wall. Because the phase contact element 45 and the neutral conductor contact element 47 are arranged so as to be offset in height with respect to the ground contact element 49, the contact sleeve 61 of the phase contact element 45 and the contact sleeve 63 of the neutral conductor contact element 47 intersect the ground contact element 49 (in the region of the insertion sleeve 27) without an electrical short circuit occurring at that location (FIG. 4). The hold-down device 51 rests on the contact elements 45, 47, 49. The make contact 53 is arranged on the hold-down device 51. The function of the make contact 53 will be described in more detail below with reference to FIGS. 5 and 6.

When inserted the hold-down device 51 engages in the grooves 59 in the housing wall. The hold-down device 51 comprises the walls 52*a*, 52*b* which extend on both sides of the ground contact element 49 and define a middle space 64 in which the contact sleeves 49.3 and 49.4 of the ground contact element 49 are arranged. The walls 52*a*, 52*b* are connected to each other at the side adjacent to the ground contact conductor 23 by means of a C-shaped wall region 66. A web 63 is also provided which connects the walls to each other at a spacing from the opposing edge. Two spaced-apart latching strips 68 are provided on the outside of the C-shaped wall region 66 and can engage between two projections 70 provided on the inside of the housing. The terminal end faces 72 of the walls 52*a*, 52*b* can likewise engage in an indentation 74 at the opposing side of the housing. The function of the walls 52*a*, 52*b* is to separate the phase contact element 45 and the neutral conductor contact element 47 from the ground contact element 49, to fix the contact elements in their position and to delimit the contact sleeves.

Arms 65 that stick out roughly at a right angle are provided on the walls 52*a*, 52*b*. These press the two electrically conductive contact elements 45, 47 onto the webs 57 and engage with their side edges in the grooves 59. Individual contact sleeves can be held and the mobility of a pin inserted in the contact sleeves can be limited by knobs 75 provided on the walls 52*a*, 52*b* or arms 65 of the hold-down device 51. The extensions 65 on the hold-down device 51 reach through openings 67 in the make contact through to the inside of the cover 43. These are used as guides for the make contact 53 and support the hold-down device 51 against the cover, so the make contact 53 is not jammed between hold-down device 51 and cover 43. Additional guides 69 are formed on the cover 43 (FIGS. 5 and 6).

Figure 5:
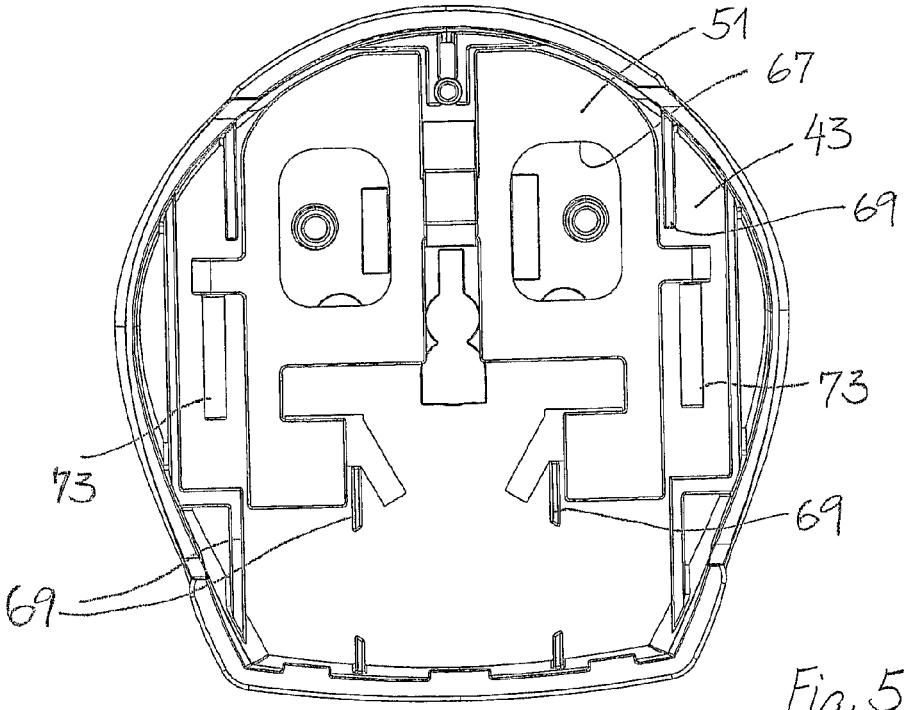
FIG. 5 shows an internal view of the cover with make contact in the closed position.
Figure 6:
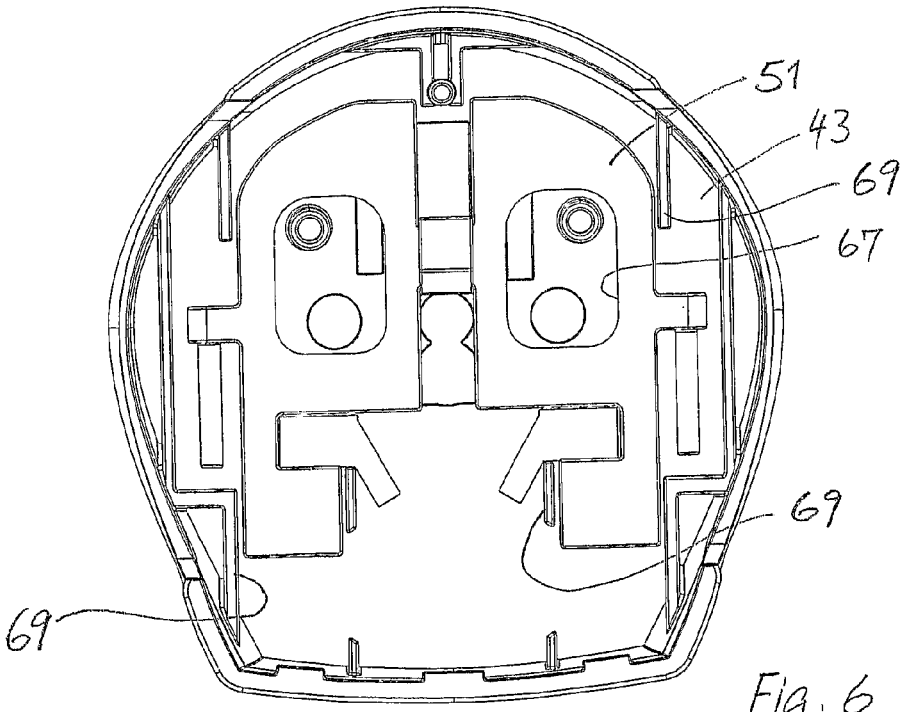
FIG. 6 shows the internal view according to FIG. 5 with the make contact in the open position.

FIG. 5 shows the make contact 53 in the closed position and FIG. 6 shows it in an open position. In FIG. 5 the insertion openings for the UK plug and the phase and neutral conductor pins of CH or IT plugs are covered. Oblique sliding surfaces 71 are formed on the make contact 53 (FIG. 4). These sliding surfaces 71 ensure that when the pins are inserted in the insertion openings provided in the cover 43, the make contact 53 is pushed to the side. The displacement takes place counter to a spring force. This spring force is applied by two compression springs (not shown) which are placed on the rods 73 and are supported on the cover 43. The make contact 53 may only be pushed to the side if the forces exerted on it by the pins are reasonably equal. When the UK plug is inserted a force is applied to the make contact by the break contact and pin in the plane of symmetry. With CH or IT plugs the required force is applied to the make contact by the two pins for phase and neutral conductor at two symmetrically arranged locations.

Figure 7:
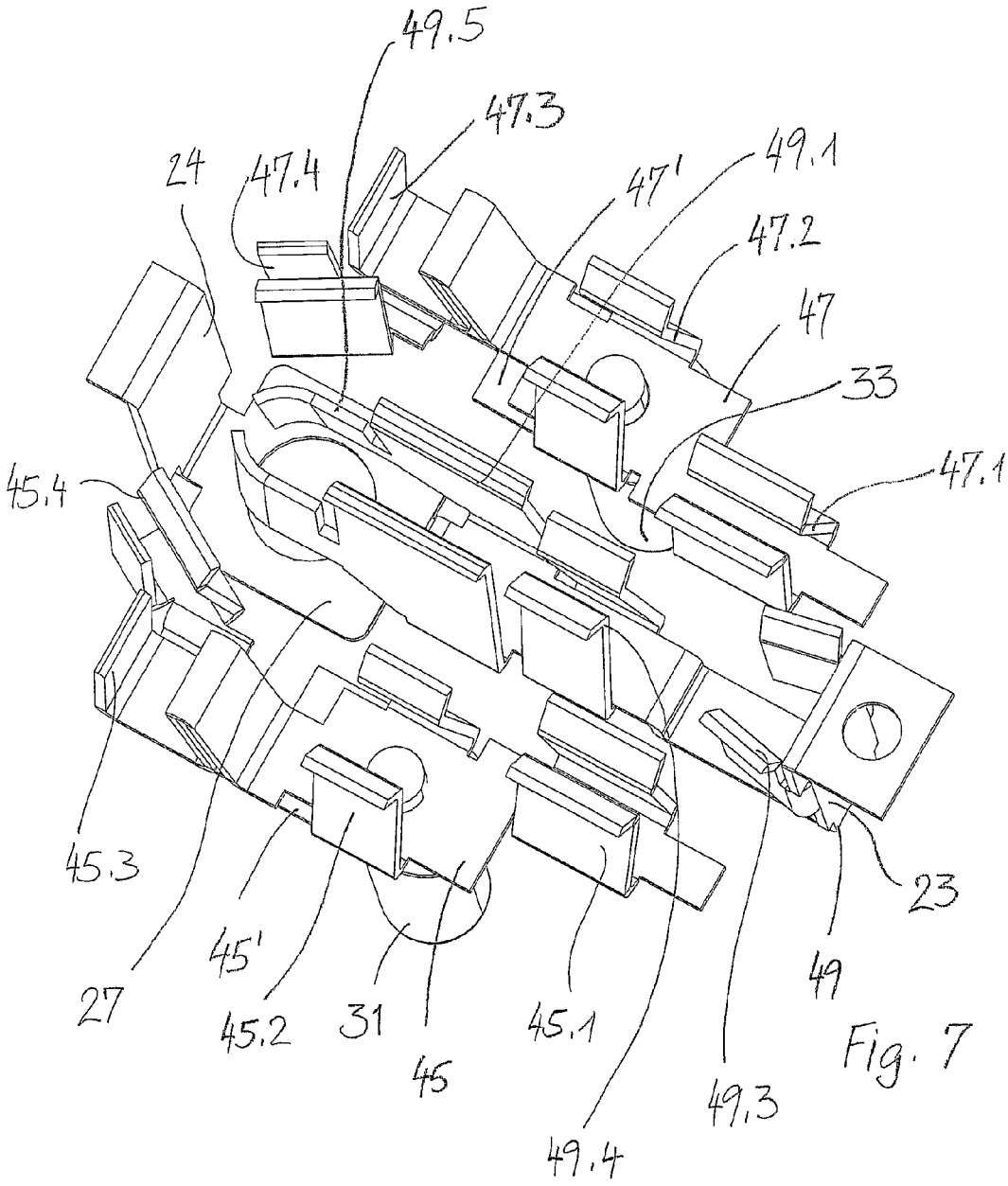
FIG. 7 shows in a perspective view the three live contact elements.

FIGS. 7 and 8 show the three electrically conductive contact elements 45, 47, 49 and FIG. 8 also shows the hold-down device 51. The contact elements 45 and 47 for the phase and neutral conductor each have four contact sleeves 45.1, 45.2, 45.3, 45.4 and 47.1, 47.2, 47.3, 47.4 which are provided on the phase contact element 45 and the neutral conductor contact element 47. The ground contact element 49 also has four contact sleeves which are designated by reference numerals 49.1, 49.3, 49.4 and 49.5. The contact sleeves 45.1, 47.1 and 49.1 are adapted to a US standard plug. The contact sleeves 45.2, 47.2 and contact sleeve 49.1 already mentioned are capable of receiving plugs of the CH standard or the IT standard. Contact sleeve 49.1 can receive the ground pins of three plug standards. Contact sleeves 45.3, 47.3, 49.3 are designed for plugs of the UK standard and the contact sleeves 45.4, 47.4 and 49.4 are designed for plugs of the AU standard. The remaining contact sleeve 49.5 is set up for the ground pin of an FR socket. The ground conductors 23 and 24 are formed on the contact element 49 moreover. The contact sleeve 49.3 is formed on the conductor 23 and receives and contacts the ground pin and break contact of the UK plug-in contact. Parts 45 and 45' are secured to grounded pin 31, parts 47 and 47' to grounded pin 33. With correct polarisation, which is specified in the case of a plug according to CEE 7/7 and the FR socket by the contact sleeve 49.5 and the FR ground pin, all parts that can be inserted in the phase contact element 45 are phase pins, all parts that can be inserted in the neutral conductor contact element 47 are neutral conductor pins and all parts that can be inserted in the ground contact element 49 are ground pins. The correct polarisation is not guaranteed with grounded sockets which do not specify polarisation and with plugs of the IT standard. However, this only relates to countries in which the correct polarisation is not specified, or equipment in which every polarisation must be possible.

The walls 52*a*, 52*b* engage in grooves 59 in the inside of the housing of the insertion body 21 at locations 77. The hold-down device 51 presses onto the electrically conductive contact elements 45, 47, 49 with regions 79 (not all are shown).

Figure 9:
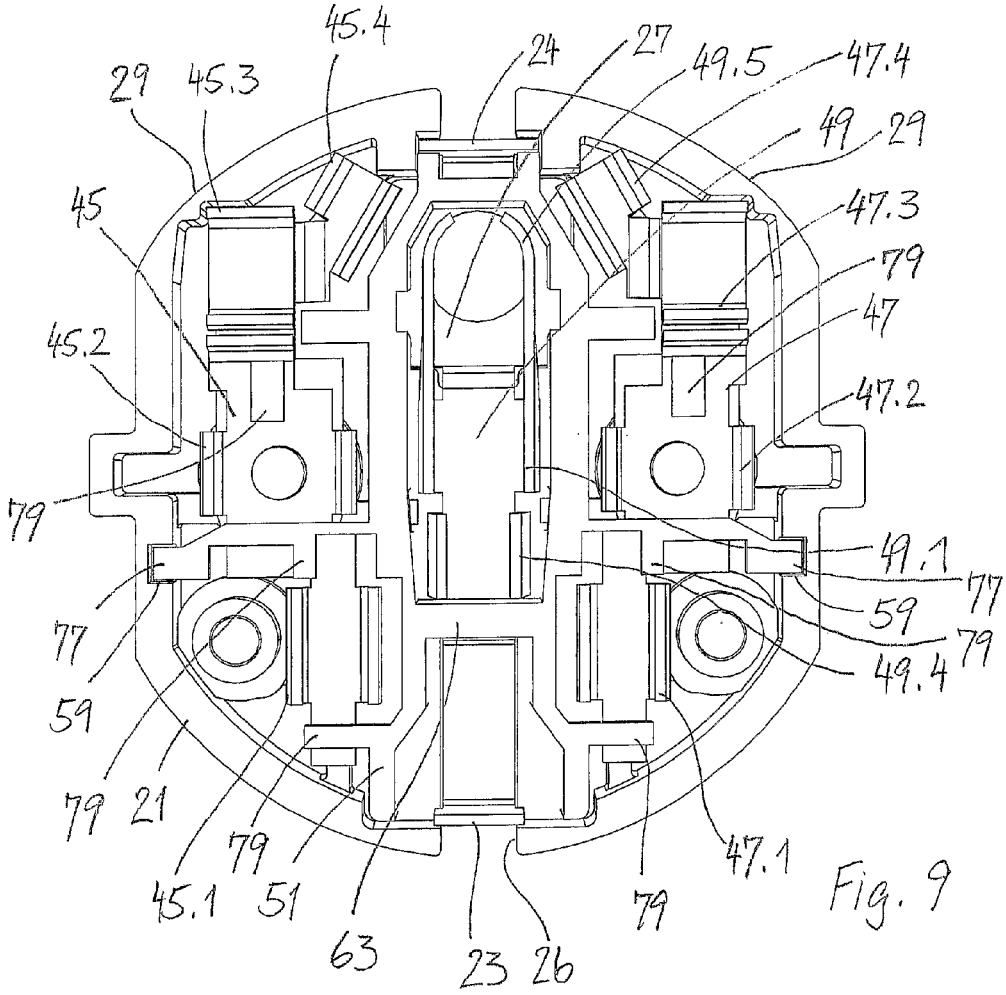
FIG. 9 shows a cross-section through the adapter plug.

The relationship between the various parts of the adapter plug 11 and their interaction are shown again by way of the sectional view of FIG. 9 by the hold-down device 51, the contact elements 45, 47, 49 and the insertion body 21. The contact sleeve 49.3, which is formed on the ground conductor 23, is no longer shown as it is formed close to the surface of the multiple socket, so immediately after inserting the UK ground pin the device that is still to be inserted fully is grounded.

Figure 10:
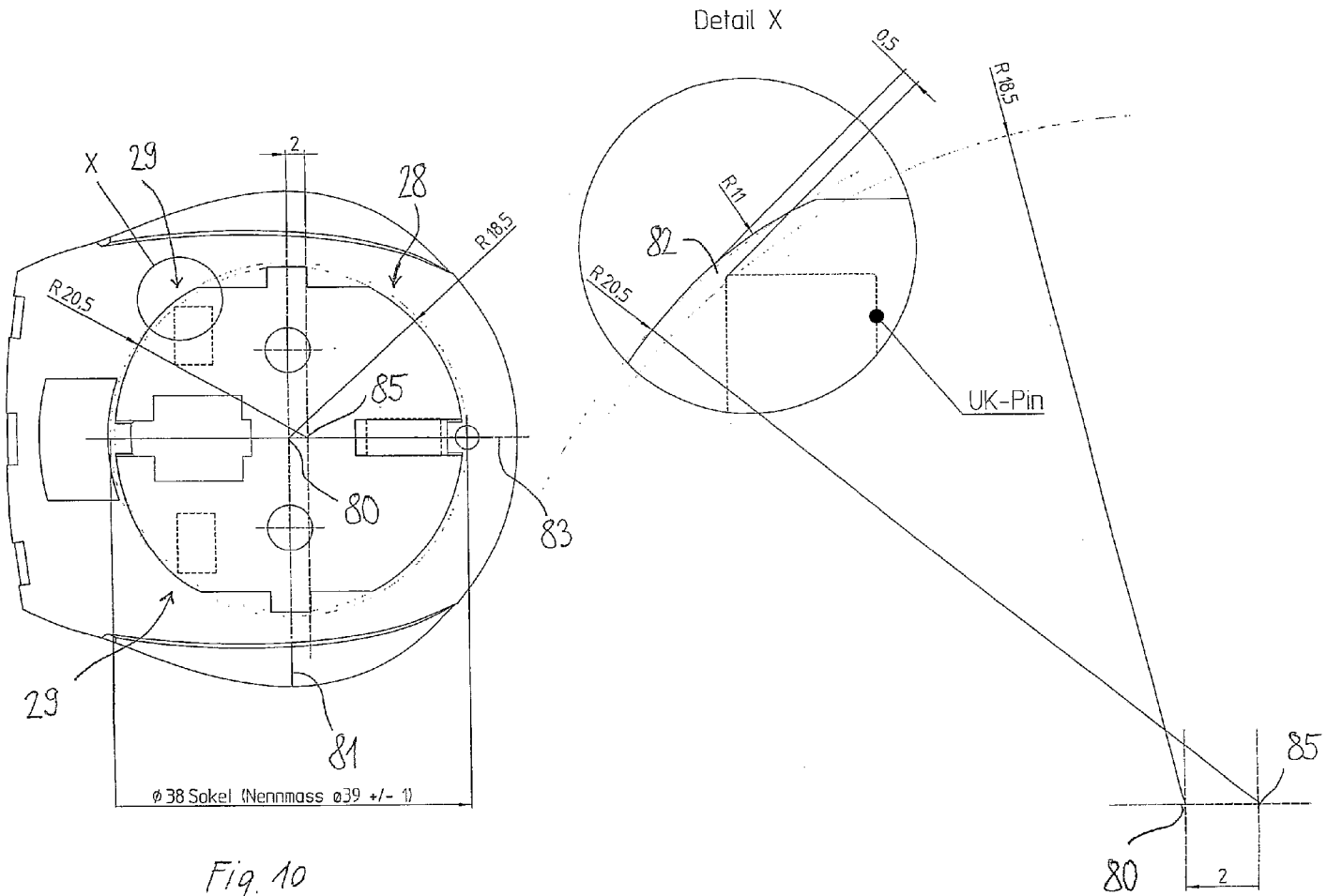
FIG. 10 shows a view of the modification of the plug housing relative to the conventional form.

FIG. 10 shows the modification of the, usually cylindrical, grounded insertion body in more detail. In the left-hand figure the minimal diameter of a grounded socket is shown as 38 mm. An adapter plug according to the invention is arranged in the grounded socket, the position of the UK pins being shown by the rectangle in broken lines.

As may be seen in particular from the enlarged detail (right-hand figure), the UK neutral conductor and phase pins poke laterally out of the housing in the normal case of a cylindrical insertion body 21 with a diameter of 37 mm. In order to prevent this, in one embodiment according to the invention the radius of the cylindrical grounded insertion body 21 is enlarged in the region 29 of the UK neutral conductor and phase pins by a certain amount, so the wall of the grounded insertion body still has a wall thickness of about 0.5 mm at the thinnest point directly adjacent to the UK pin. In order not to exceed the maximum diameter of the grounded insertion body demanded by the standard, diametrically opposed to the locations 28 the radius can also be reduced by a certain amount, so the diameter of 37 mm is retained. These deviations in the round housing sections from the cylindrical form of the insertion body lie within the permitted tolerances, so, even in an extreme case where the grounded socket has the minimal dimension and the grounded insertion body of the adapter plug has the maximal dimension, the adapter plug can still be inserted in said grounded socket.

As FIG. 10 shows, the modification according to the invention may be achieved, by way of example, by offsetting, by for example 2 mm, from the actual centre 80, a radius of, for example, 20.5 mm above the maximal radius of 18.5. The centre 28 of the plug housing is given by the intersection of the plane of symmetry 81 with a plane 83 passing through the two grounded pins. The centre 85 of the larger radius lies in the plane of symmetry 81 and closer to the contact sleeve of the UK ground pin in this case. As a result a wall thickness of 0.5 mm may be achieved in the region of the UK neutral conductor and phase contact pins. As may also be seen from FIG. 10, the deviation of the outer contour of the grounded insertion body from a cylinder with a radius of 18.5 mm heads toward zero in the direction of the plane of symmetry. It is understood that a deviation from radius 18.5 mm is only required on the left half of the grounded insertion body, where the UK neutral conductor and phase pins are inserted. A corresponding reduction in the radius may analogously be provided on the right half of the cylindrical grounded insertion body, so the diameter of the grounded insertion body overall has the required maximal 37 mm.

Basically, instead of a continuous radius a local protrusion may also be provided only in the region of the UK neutral conductor and phase contact sleeves. This would serve the purpose equally as well but would be less aesthetically appealing.

The invention claimed is:

1. A three-pole adapter plug of the standard CEE 7/7 with an additional contact sleeve for a FR grounded pin, comprising:

a plug assembly, a first side of the plug assembly having a grounded plug comprising two pins and two grounded conductors;

a second side of the plug assembly, opposite to the first side, having a socket for at least one plug of British standard;

a housing of the plug assembly forming a grounded insertion body; and a plurality of contact sleeves for plug pins of British standards being arranged within the grounded insertion body, one of the plurality of contact sleeves for the grounded pin of British standard being arranged in a same plane of symmetry as the two grounded conductors of the grounded plug, the plurality of contact sleeves for a three-pole UK plug are accommodated completely within a closed grounded insertion body, the grounded insertion body not being rotationally symmetrical in rounded parts thereof.

2. The adapter plug of claim 1, wherein at least in a region where a UK neutral conductor sleeve and a UK phase contact sleeve are arranged, the housing of the grounded insertion body has a non-cylindrical shape.

3. The adapter plug of claim 1, wherein in a region that diametrically opposes regions of the plug housing of the grounded insertion body has a non-cylindrical shape.

4. The adapter plug of claim 1, wherein the grounded conductor that is adjacent to the contact sleeve of the UK grounded pin has a smaller spacing from a cylinder encompassing the insertion body that is within a margin which is compatible with grounded sockets compliant with standards.

5. The adapter plug of claim 1, wherein the outer shape of the insertion body is wider at two locations opposing the grounded conductor that forms the contact sleeve, so at these locations the outer wall of the insertion body extends beyond the maximum cylindrical space defined by standard CEE 7/7.

6. The adapter plug of claim 1, wherein at two of the locations opposing the grounded conductor that forms the contact sleeve the insertion body has two slots in a housing which are filled by the neutral conductor and phase pins of a UK plug inserted in the socket.

7. The adapter plug of claim 1, wherein a grounded contact element is present which forms all grounded contact sleeves for the socket, for the grounded conductors of the grounded plug and, optionally, for the contact sleeve for the FR grounded pin.

8. The adapter plug of claims claim 1, wherein a phase contact element and a neutral conductor element are present and form the corresponding contact sleeves for the socket and are connected to the pins of the grounded plug.

9. The adapter plug of claim 8, wherein the phase contact element and the neutral conductor contact element each consist of two conductor parts that are connected to each other by the pin of the grounded plug.

10. The adapter plug of claim 1, further comprising a hold-down device that supports the contact sleeves within the insertion body, including the grounded contact element, the phase contact element and the neutral contact element, with respect to the housing.

11. The adapter plug of claim 10, wherein the hold-down device separates the contact sleeves for phase, the contact sleeves for ground and the contact sleeves for the neutral conductor from each other.

12. The adapter plug of claim 11, further comprising grooves formed in the insertion body on the inside of the housing into which the hold-down device extends.

13. The adapter plug of claim 1, further comprising a displaceably mounted make contact is present which may be displaced, counter to a spring force by the UK grounded pin that is to be inserted into the socket, from a position that closes insertion openings for the UK pins into a position that opens the insertion openings.

14. The adapter plug of claim 1, wherein the hold-down device forms a guide for the make contact.

15. The adapter plug of claim 1, wherein the hold-down device comprises a cover supported on the housing through openings in the make contact.

* * * * *